US010677457B2

(12) United States Patent
Tominaga et al.

(10) Patent No.: US 10,677,457 B2
(45) Date of Patent: Jun. 9, 2020

(54) COMBUSTION BURNER AND BOILER EQUIPPED WITH THE SAME

(71) Applicant: MITSUBISHI HITACHI POWER SYSTEMS, LTD., Yokohama-shi, Kanagawa (JP)

(72) Inventors: Yukihiro Tominaga, Tokyo (JP); Keigo Matsumoto, Tokyo (JP); Kazuhiro Domoto, Yokohama (JP); Ryuichiro Tanaka, Yokohama (JP); Naofumi Abe, Yokohama (JP); Jun Kasai, Yokohama (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 141 days.

(21) Appl. No.: 15/736,108

(22) PCT Filed: Aug. 1, 2016

(86) PCT No.: PCT/JP2016/072564
§ 371 (c)(1),
(2) Date: Dec. 13, 2017

(87) PCT Pub. No.: WO2017/043218
PCT Pub. Date: Mar. 16, 2017

(65) Prior Publication Data

US 2018/0195715 A1 Jul. 12, 2018

(30) Foreign Application Priority Data

Sep. 11, 2015 (JP) ..... 2015-179764

(51) Int. Cl.
*F23D 1/00* (2006.01)
*F23D 23/00* (2006.01)

(52) U.S. Cl.
CPC ..... *F23D 1/00* (2013.01); *F23D 23/00* (2013.01); *F23D 2201/10* (2013.01); *F23D 2201/20* (2013.01)

(58) Field of Classification Search
CPC ..... F23D 1/00; F23D 23/00
See application file for complete search history.

(56) References Cited

U.S. PATENT DOCUMENTS 24,766,494 8/1904 Crone
1,103,253 A 7/1914 Bennett
(Continued)

FOREIGN PATENT DOCUMENTS

CN 2281479 Y 5/1998
CN 2415254 Y 1/2001
(Continued)

OTHER PUBLICATIONS

International Search Report dated Apr. 19, 2016, issued in International Application No. PCT/JP2016/054978, with English translation (4 pages).
(Continued)

*Primary Examiner* — Jason Lau
(74) *Attorney, Agent, or Firm* — Westerman, Hattori, Daniels & Adrian, LLP

(57) ABSTRACT

A combustion burner includes a plurality of splitters (5), (6), (7) configured to divide a fuel gas flow by a widened portion where a width of the widened portion increases as the widened portion extends in the direction of the fuel gas flow. The splitters include: slitted splitters (5), (6) configured to slits (SL) at a downstream end in the fuel gas flow; and non-slitted splitters (7) configured to adjacently to the slitted splitters (5), (6), each of the non-slitted splitters (7) config-
(Continued)

ured to the widened portion at a downstream end in the fuel gas flow, and configured to a fixed width in a direction of the longitudinal axis.

7 Claims, 5 Drawing Sheets

(56) References Cited

U.S. PATENT DOCUMENTS

| | | | |
|---|---|---|---|
| 1,887,330 | A | 11/1932 | Shaw |
| 2,149,980 | A | 3/1939 | Paret, Jr. |
| 2,259,010 | A | 10/1941 | Taylor |
| 2,360,548 | A | 10/1944 | Conway |
| 2,895,435 | A | 7/1959 | Bogot |
| 3,112,988 | A | 12/1963 | Colden |
| 3,209,811 | A | 10/1965 | Strang |
| 3,213,919 | A | 10/1965 | Calzolari |
| 3,823,875 | A | 7/1974 | Bauer et al. |
| 4,284,402 | A | 8/1981 | Sheets et al. |
| 4,520,739 | A | 6/1985 | McCartney et al. |
| 4,634,054 | A | 1/1987 | Grusha |
| 5,215,259 | A | 6/1993 | Wark |
| 5,231,937 | A | 8/1993 | Kobayashi et al. |
| 5,292,246 | A | 3/1994 | Gateau et al. |
| 5,483,906 | A | 1/1996 | Hufton |
| 5,529,000 | A | 6/1996 | Hartel et al. |
| 5,782,626 | A | 7/1998 | Joos et al. |
| 6,003,793 | A | 12/1999 | Mann |
| 6,089,171 | A | 7/2000 | Fong et al. |
| 6,158,223 | A | 12/2000 | Mandai et al. |
| 6,334,770 | B1 | 1/2002 | Giraud et al. |
| 6,461,145 | B1 | 10/2002 | Giraud et al. |
| 6,579,085 | B1 | 6/2003 | Satchell, Jr. et al. |
| 7,163,392 | B2 | 1/2007 | Feese et al. |
| 7,500,849 | B2 | 3/2009 | Dudill et al. |
| 8,070,484 | B2 | 12/2011 | Just et al. |
| 8,105,075 | B2 | 1/2012 | Huau |
| 8,393,892 | B2 | 3/2013 | Hagihara et al. |
| 9,546,784 | B2 | 1/2017 | Van Der Ploeg et al. |
| 2008/0206696 | A1 | 8/2008 | Wark |
| 2008/0268387 | A1 | 10/2008 | Saito |
| 2009/0214989 | A1 | 8/2009 | Swanson et al. |
| 2009/0220899 | A1 | 9/2009 | Spangelo et al. |
| 2009/0277364 | A1* | 11/2009 | Donais ..... F23C 7/008 110/263 |
| 2010/0044282 | A1 | 2/2010 | Zarnescu et al. |
| 2010/0064986 | A1 | 3/2010 | Kiyama et al. |
| 2012/0171629 | A1 | 7/2012 | Kang et al. |
| 2012/0247376 | A1 | 10/2012 | Matsumoto et al. |
| 2013/0291770 | A1 | 11/2013 | Kashima et al. |
| 2014/0011141 | A1* | 1/2014 | Matsumoto ..... F23C 5/32 431/12 |
| 2014/0227647 | A1 | 8/2014 | Mueller-Hagedorn et al. |
| 2015/0068438 | A1 | 3/2015 | Taniguchi et al. |
| 2016/0010853 | A1 | 1/2016 | Matsumoto et al. |
| 2016/0356489 | A1 | 12/2016 | Matsumoto et al. |
| 2016/0356490 | A1 | 12/2016 | Matsumoto et al. |
| 2016/0356494 | A1 | 12/2016 | Matsumoto et al. |
| 2017/0045221 | A1 | 2/2017 | Matsumoto et al. |

FOREIGN PATENT DOCUMENTS

| | | | |
|---|---|---|---|
| CN | 1 407 274 | A | 4/2003 |
| CN | 201302156 | Y | 9/2009 |
| CN | 102620291 | A | 8/2012 |
| CN | 202938290 | U | 5/2013 |
| CN | 103267282 | A | 8/2013 |
| CN | 103443543 | A | 12/2013 |
| CN | 103672883 | A | 3/2014 |
| CN | 203718765 | U | 7/2014 |
| CN | 104100969 | A | 10/2014 |
| EP | 0035153 | A1 | 9/1981 |
| EP | 0 129 001 | A1 | 12/1984 |
| EP | 2 267 365 | A2 | 12/2010 |
| EP | 2 518 404 | A1 | 10/2012 |
| EP | 2659186 | A2 | 11/2013 |
| EP | 2 696 139 | A1 | 2/2014 |
| JP | S59-009414 | A | 1/1984 |
| JP | S59-077206 | A | 5/1984 |
| JP | 59-205510 | A | 11/1984 |
| JP | S60-103207 | A | 6/1985 |
| JP | 1-217109 | A | 8/1989 |
| JP | 4-24404 | A | 1/1992 |
| JP | 8-135919 | A | 5/1996 |
| JP | 9-203505 | A | 8/1997 |
| JP | 11-072230 | A | 3/1999 |
| JP | 11-281010 | A | 10/1999 |
| JP | 2009-204256 | A | 9/2009 |
| JP | 2010-270992 | A | 12/2010 |
| JP | 2011-149676 | A | 8/2011 |
| JP | 2012-122653 | A | 6/2012 |
| JP | 2012-215362 | A | 11/2012 |
| JP | 2012-215363 | A | 11/2012 |
| JP | 2015-52450 | A | 3/2015 |
| WO | 2008/038426 | A1 | 4/2008 |
| WO | 2012/098848 | A1 | 7/2012 |
| WO | 2012/137573 | A1 | 10/2012 |

OTHER PUBLICATIONS

Written Opinion dated Apr. 19, 2016, issued in International Application No. PCT/JP2016/054978, with English translation (10 pages).
International Search Report dated Apr. 19, 2016, issued in International Application No. PCT/JP2016/055008, with English translation (5 pages).
Extended Search Report dated Feb. 12, 2018, issued in European Application No. 16771965.7 (7 pages).
Written Opinion dated Apr. 19, 2016, issued in Application No. PCT/JP2016/055008, with English Translation. (7 pages).
Extended Search Report dated Jun. 20, 2018, issued in counterpart European Application No. 16844082.4 (10 pages).
Extended Search Report dated Jun. 22, 2018, issued in European Application No. 16771963.2 (7 pages).
International Search Report dated Sep. 20, 2016, issued in counterpart International Application No. PCT/JP2016/072564 (5 pages).
Office Action dated Jun. 5, 2018, issued in Japanese Application No. 2017-509377, with English translation (13 pages).
Office Action dated Jun. 5, 2018, issued in Japanese Application No. 2017-509379, with English translation (11 pages).
Nritten Opinion dated Sep. 20, 2016, issued in counterpart Application No. PCT/JP2016/072564 (10 pages).
Duayle Action dated Mar. 8, 2019, issued in U.S. Appl. No. 15/553,273 (9 pages).
Office Action dated Mar. 13, 2019, issued in CN application No. 201680011710.1(counterpart to U.S. Appl. No. 15/553,273: with English translation. (11 pages).
Non-Final Office Action dated Mar. 21, 2019, issued in U.S. Appl. No. 15/553,307 (31 pages).
Office Action dated Aug. 2, 2018. issued in counterpart Chinese Application No. 201680011710.1, with English translation (12 pages).
Office Action dated Sep. 20, 2018, issued in counterpart Korean Application No. 10-2017-7021755, with English translation (13 pages).
Office Action dated Dec. 18, 2018, issued in counterpart KR Application No. 10-2017-7036865, with English translation (12 pages).
Office Action dated Jun. 3, 2019, issued in CN Application No. 201680037949.6, with English translation (10 pages).
Office Action dated Aug. 2, 2019, issued in counterpart in application No. 201747027882, with English translation. (6 pages).
Office Action dated Jan. 10, 2020, issued in CN Application No. 201680011710.1 (counterpart to U.S. Pat. No. 10,458,645), with English Translation. (17 pages).

* cited by examiner

COMBUSTION BURNER AND BOILER EQUIPPED WITH THE SAME

TECHNICAL FIELD

The present disclosure relates to a combustion burner and a boiler equipped with the same.

BACKGROUND ART

As a combustion burner for combusting pulverized coal fuel, there is known a burner where a plurality of flame holders, which are referred to as "splitters", are disposed at an outlet of a fuel nozzle of the burner. In the burner, a recirculation region is formed on a downstream side of the splitters to maintain combustion of pulverized coal. In this manner, ignition and flame holding (hereinafter referred to as "internal ignition" or "internal flame holding") are performed in the vicinity of a center axis of the fuel nozzle so that reduced combustion is performed under an air deficiency condition to realize low NOx combustion.

To enhance flame holding performance, it is preferable that a flame holder have a long edge length of splitter length. However, when the number of splitters is increased, a blocking rate of an outlet of a burner and hence, pressure loss of the burner is increased. Further, even when the number of splitters is increased while reducing a width of the splitters so as to ensure the edge length of splitter length, the splitters are disposed close to a wall portion of the fuel nozzle and hence, there is a possibility that ignition occurs at an outer periphery of the fuel nozzle. A combustion air supply nozzle and the like are disposed outside the fuel nozzle so that a large amount of oxygen is present, and therefore when external ignition occurs, there is a risk that a large amount of NOx is generated.

The following PTL 1 and PTL 2 disclose combustion burners where splitters are formed into a comb shape when the splitters are viewed in a front view from the downstream side.

CITATION LIST

Patent Literature

{PTL 1}
Japanese Unexamined Patent Application, Publication No. Sho 59-205510
{PTL 2}
Japanese Unexamined Patent Application, Publication No. 2009-204256

SUMMARY OF INVENTION

Technical Problem

When the splitters are formed into a comb shape as described in the above-mentioned respective patent literatures, an edge length of splitter length can be ensured.

However, the splitter described in PTL 1 is configured to introduce pulverized coal to the outer peripheral side of a nozzle so that external ignition is performed. Accordingly, low NOx combustion cannot be realized with such a configuration.

In the technique disclosed in PTL 2, air is injected from the splitter. Accordingly, combustion performed in a fuel nozzle is promoted so that reduced combustion is inhibited and hence, low NOx combustion cannot be realized.

The present disclosure is made under such circumstances, and it is an object of the present disclosure to provide a combustion burner where an edge length of splitter length of a splitter is increased and flame holding performance is enhanced so that low NOx combustion can be realized by internal flame holding, and a boiler equipped with the same.

Solution to Problem

To solve the problems described above, a combustion burner and a boiler equipped with the same according to the present disclosure adopt the following solutions.

That is, according to one aspect of the present disclosure, there is provided a combustion burner which includes: a fuel nozzle through which a fuel gas obtained by mixing a fuel and air with each other is blown into a furnace; and a plurality of splitters configured to divide a fuel gas flow by a widened portion where a width of the widened portion increases as the widened portion extends in a direction of the fuel gas flow, the splitters being disposed in the fuel nozzle on a distal end side of the fuel nozzle such that longitudinal axes of the splitters extend from a side of one wall portion of the fuel nozzle to a side of the other wall portion which is disposed on a side opposite to said one wall portion, wherein the plurality of splitters include: a slitted splitters configured to slit which partially reduces a width of the widened portion at a downstream end in the fuel gas flow, and a non-slitted splitters configured to adjacently to the slitted splitters, the non-slitted splitters having the widened portion, and the widened portion at a downstream end in the fuel gas flow having a fixed width in a direction of the longitudinal axis.

The slitted splitter has the slit so that an edge length of splitter length of the slitted splitter is increased whereby flame holding performance is enhanced. Accordingly, internal flame holding where a flame is held on the inside of the fuel nozzle is strengthened.

The non-slitted splitter forms a recirculation region on the downstream of the widened portion and thus has a flame holding function, but also has a function as a guide member which guides a fuel to the slitted splitter disposed adjacently to the non-slitted splitter by making use of inclined surfaces of the widened portion. Accordingly, internal flame holding by the slitted splitter is further strengthened.

Further, according to another aspect of the present disclosure, there is provided a combustion burner which includes: a fuel nozzle through which a fuel gas obtained by mixing a fuel and air with each other is blown into a furnace; and a plurality of splitters configured to divide a fuel gas flow by a widened portion where a width of the widened portion increases as the widened portion extends in a direction of the fuel gas flow, the splitters being disposed in the fuel nozzle on a distal end side of the fuel nozzle such that longitudinal axes of the splitters extend from a side of one wall portion of the fuel nozzle to a side of the other wall portion which is disposed on a side opposite to said one wall portion, wherein the splitter includes a plurality of slitted splitters having a slit which partially reduces a width of the widened portion at a downstream end in the fuel gas flow, and the slitted splitters disposed adjacently to each other respectively include wide surfaces having no slit, and the wide surfaces of the widened portions of the slitted splitters oppositely face each other.

The slitted splitters are disposed adjacently to each other, and the wide surfaces having no slit oppositely face each other so that a fuel guided by the wide surface of one splitter is introduced to a downstream side of the other splitter. In this way, a fuel is guided between the wide surfaces disposed adjacently to each other in an oppositely facing manner so that flame holding is strengthened on both splitters.

Further, the splitter does not inject air and hence, there is no possibility that a flow of the guided fuel is inhibited.

A surface forming the slit of the slitted splitter may be formed of an inclined surface which deflects the fuel gas flow in the direction of the longitudinal axis.

The inclined surface forming the slit deflects the fuel gas flow in the direction of the longitudinal axis of the splitter. Accordingly, the fuel gas flow can become turbulent also in the direction of the longitudinal axis and hence, flame holding performance can be further enhanced. Particularly, the slit can be three-dimensionally formed by respective surfaces forming the slit and hence, flame holding performance can be enhanced.

The splitters may be disposed at different positions in the direction of the fuel gas flow.

The splitters are disposed at different positions in the direction of the fuel gas flow, that is, the splitters are disposed in a displaced manner toward the upstream side and toward the downstream side in the direction of the fuel gas flow. Accordingly, compared to a case where the splitters are disposed at the same position in the direction of the fuel gas flow, an area which the widened portions of the splitters occupy can be reduced. With such a configuration, an increase in speed of a fuel gas can be suppressed so that a flow speed of a fuel gas toward the downstream side in the direction of the fuel gas flow can be approximated to a combustion speed of a fuel gas toward the upstream side so that ignition can be performed at an early stage before the fuel gas further flows toward the downstream side and hence, flame holding performance of the flame can be enhanced.

Ignition can be performed at the early stage by the splitters positioned on the upstream side in the fuel gas flow, and ignition or flame holding can be strengthened by the splitters positioned on the downstream side in the fuel gas flow.

Further, the splitters positioned on the upstream side in the fuel gas flow can introduce a fuel to the recirculation region for the splitters on the downstream side so that ignition or flame holding by the splitters on the downstream side can be strengthened. In this case, it is preferable that the non-slitted splitters be disposed on the upstream side, and the slitted splitters be disposed on the downstream side.

A flow straightening plate which is configured to separate a wall surface side of the fuel nozzle and the splitter from each other may be disposed at an end portion of the splitter in the longitudinal direction.

At the end portion of the splitter in the longitudinal direction, there is a possibility that ignition occurs using the end portion as a base point so that external ignition occurs at an outer peripheral portion of the fuel nozzle. A combustion air supply nozzle and the like are disposed outside the fuel nozzle so that a large amount of oxygen is present, which causes a large amount of NOx to be generated when external ignition occurs.

In view of the above, the flow straightening plate is provided, which separates the wall surface side of the fuel nozzle and the splitter from each other. Accordingly, external ignition, where ignition is performed at the end portion of the splitter, can be suppressed so that internal ignition and flame holding can be further strengthened.

The splitter may have a corner-removed portion, where a corner portion is removed, at a downstream end corner portion of the widened portion.

If a splitter has an corner portion at the downstream end corner portion of the widened portion, there is a possibility that the splitter receives radiation from the inner peripheral surface side of the fuel nozzle so that ignition occurs using the corner portion as a starting point whereby external ignition occurs at the outer peripheral portion of the fuel nozzle. A combustion air supply nozzle and the like are disposed outside the fuel nozzle so that a large amount of oxygen is present. Accordingly, when external ignition occurs, a large amount of NOx is generated.

In view of the above, the corner portion-removed portion, where the corner portion is removed, is formed on the splitter so as to suppress ignition or flame holding.

As the corner portion-removed portion, a tapered portion where a corner portion is chamfered can be named, for example.

According to another aspect of the present disclosure, there is provided a boiler which includes: a furnace; any one of the above-described combustion burners provided in the furnace; a flue provided on a downstream side of the furnace; and a heat exchanger provided in the flue.

With the provision of the combustion burner described above, it is possible to provide a boiler which performs low NOx combustion.

Advantageous Effects of Invention

With the formation of the slit, an edge length of splitter length of the splitter on a front surface can be increased and, at the same time, a fuel can be guided to a recirculation region which is formed by the adjacent splitter, whereby flame holding performance at a center region of the fuel nozzle is enhanced, and low NOx combustion brought about by internal flame holding can be realized.

DESCRIPTION OF EMBODIMENTS

Figure 1:
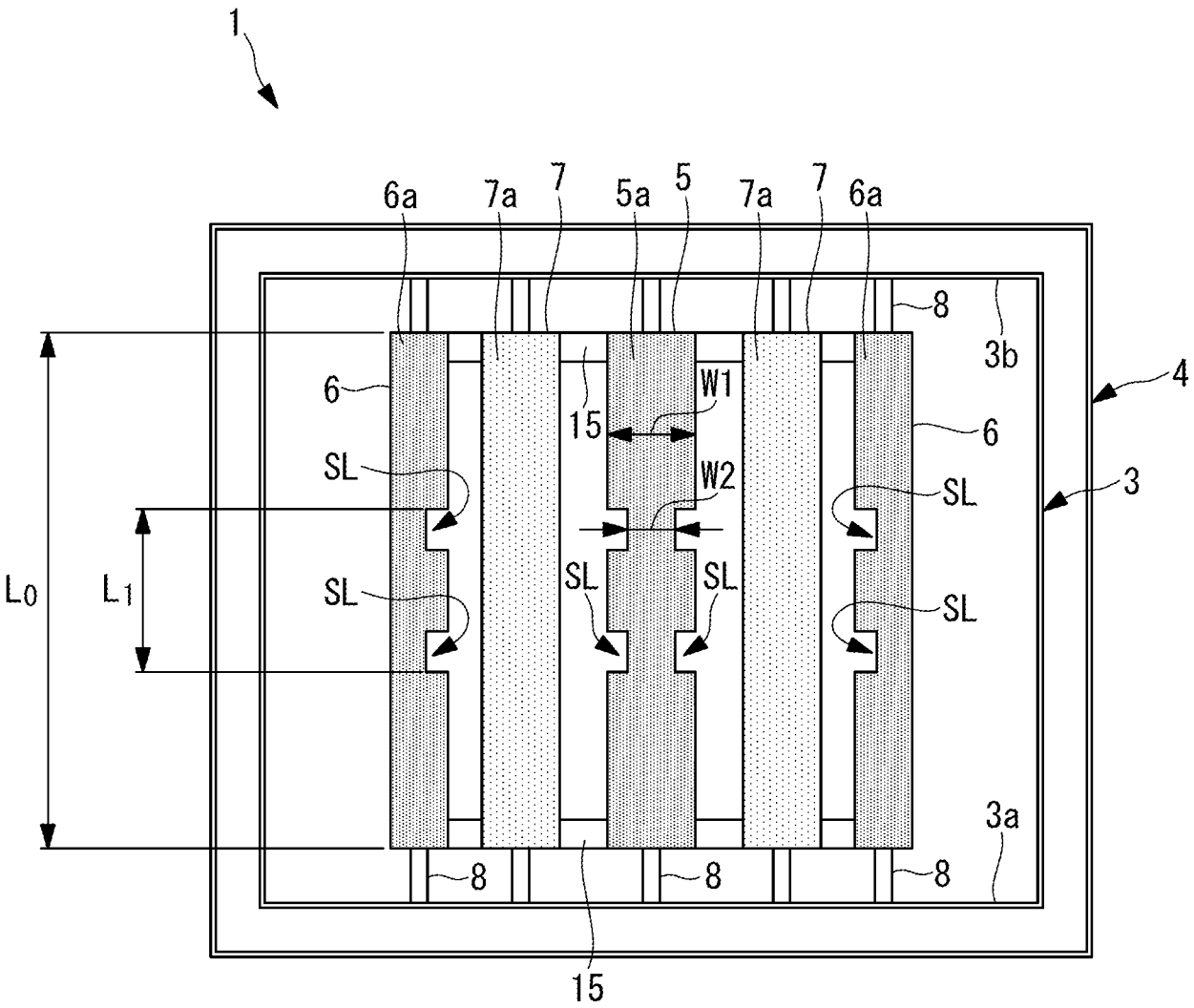
FIG. 1 is a front view showing a fuel nozzle according to a first embodiment of the present disclosure.

Hereinafter, embodiments according to the present disclosure are described with reference to drawings.

First Embodiment

Hereinafter, a first embodiment of the present disclosure is described with reference to FIGS. 1 to 3.

A combustion burner of this embodiment combusts a pulverized coal fuel (fuel) obtained by pulverizing mainly coal by a mill, and is provided in a boiler (not shown in the drawing). A plurality of combustion burners are provided for the boiler which includes heat exchange such as a superheater and an evaporator in a flue, and the combustion burners form flames in a furnace.

FIG. 1 is a front view of a combustion burner 1. The combustion burner 1 includes: a fuel nozzle 3 positioned on the inner side; and a combustion air supply nozzle 4 surrounding the fuel nozzle 3.

The combustion air supply nozzle 4 forms a flow passage through which only a secondary air passes. Air is supplied through the combustion air supply nozzle 4 such that the air travels in a straight line toward the inside of the furnace. That is, air flowing out from the combustion air supply nozzle 4 is made to flow parallel to a fuel gas flowing out from the fuel nozzle 3 so as not to intersect with the fuel gas flowing out from the fuel nozzle 3. Although not shown in the drawing, a tertiary combustion air nozzle, through which combustion air is supplied, is disposed outside the combustion air supply nozzle 4.

As shown in FIG. 1, the fuel nozzle 3 has a rectangular cross section as viewed in a front view, and a fuel gas obtained by mixing pulverized coal and air with each other is made to flow through the inside of the fuel nozzle 3. In the following respective embodiments, the downstream side in a fuel gas flow is simply referred to as "downstream side", and the upstream side in the fuel gas flow is simply referred to as "upstream side".

A plurality of splitters 5, 6, 7 are disposed in the fuel nozzle 3, and five splitters are disposed in this embodiment. Each of the splitters 5, 6, 7 is disposed such that a longitudinal axis thereof extends from the side of a lower wall portion (one wall portion) 3*a* of the fuel nozzle 3 to the side of an upper wall portion (the other wall portion) 3*b* which is disposed on a side opposite to the lower wall portion 3*a*. That is, each of the splitters 5, 6, 7 is a vertical splitter which is disposed so as to extend in the vertical direction. Upper and lower ends of the splitters 5, 6, 7 are fixed to wall portions of the fuel nozzle 3 by support members 8 respectively.

The fuel nozzle 3 includes a nozzle angle adjusting mechanism which is rotatable in the up-and-down direction together with the splitters 5, 6, 7. In this embodiment, vertical splitters are used so that even when an angle of the nozzle is adjusted in the up-and-down direction, a flow of a fuel gas is not largely deflected, which is preferable.

The splitters 5, 6, 7 are members having a function of dividing a fuel gas flow, but do not have a function of injecting air from the inside.

The splitters include: slitted splitters 5 and 6 disposed in the center and on both ends in the horizontal direction; and non-slitted splitters 7 adjacently disposed on both sides of the slitted splitter 5 disposed in the center. In this way, each non-slitted splitter 7 is disposed at a position where the non-slitted splitter 7 is disposed adjacently to the slitted splitters 5, 6.

Figure 2:
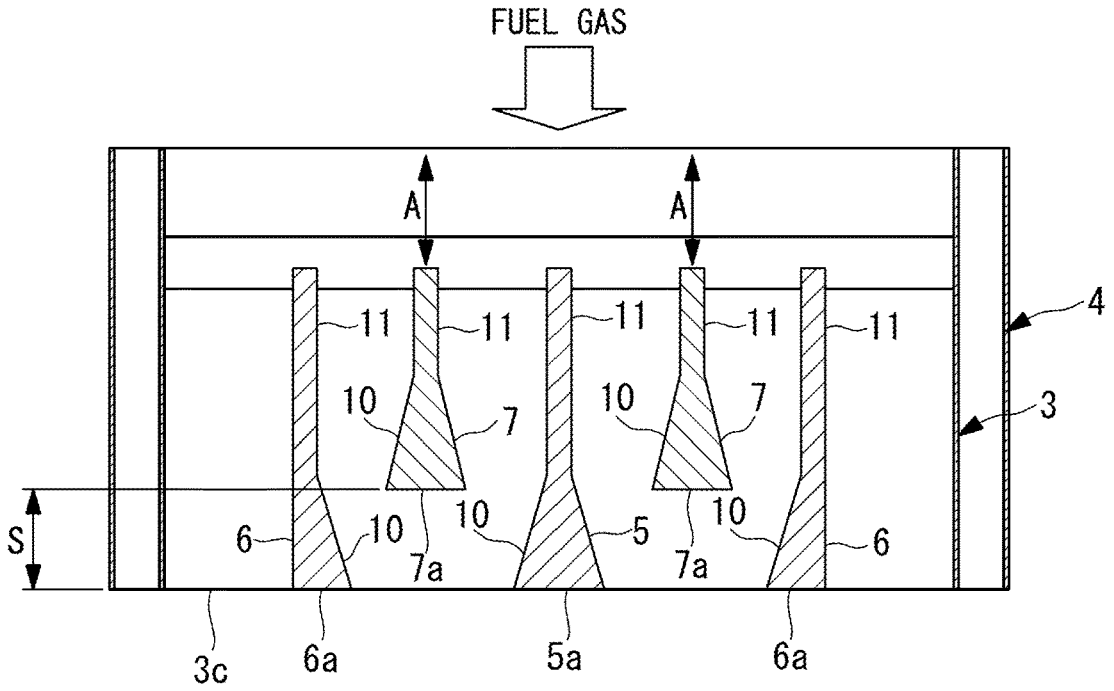
FIG. 2 is a cross-sectional view of the fuel nozzle shown in FIG. 1 taken along a horizontal plane.

As shown in FIG. 2, the splitters 5, 6, 7 include a widened portion 10 where a width of the widened portion 10 is increased as the widened portion 10 extends in the direction of the fuel gas flow. Further, a plate-shaped portion 11 which extends in the up-and-down direction is disposed on the upstream side of the widened portion 10 along the direction of the fuel gas flow.

The widened portions 10 have an approximately triangular shape as shown in FIG. 2 as viewed in a cross-sectional view. The widened portion 10 of the slitted splitter 5 disposed at the center and the widened portion 10 of the non-slitted splitter 7 respectively have a shape where a width of the widened portion 10 is increased toward both sides as shown in FIG. 2 as viewed in a cross-sectional view. On the other hand, the widened portion 10 of the slitted splitter 6 positioned at both ends in the horizontal direction has a shape where a width of the widened portion 10 is increased toward the center side of the fuel nozzle 3 but is not increased toward the wall portion side of the fuel nozzle 3. In this way, the downstream side of the slitted splitter 6 positioned on both sides is formed into a straight line shape so that a fuel gas which flows between the wall surface of the fuel nozzle 3 and the slitted splitter 6 is prevented from deflecting toward the side of a flow of air flowing out from the combustion air supply nozzle 4. With such a configuration, external ignition which occurs on the outer peripheral side of the fuel nozzle 3 can be suppressed.

As shown in FIG. 2, downstream ends 5*a*, 6*a* of the slitted splitters 5, 6 are aligned at a position of a downstream end 3*c* of the fuel nozzle 3. Downstream ends 7*a* of the non-slitted splitters 7 are disposed at a predetermined distance S toward the upstream side from the downstream ends 5*a*, 6*a* of the slitted splitters 5, 6.

In this embodiment, assuming an equivalent circle diameter of an opening of the fuel nozzle 3 as "D", the predetermined distance S is set to 0.001 D or more and 1.0 D or less, and more preferably set to 0.03 D or more and 0.5 D or less. It is further preferable to set the predetermined distance S to 0.05 D or more and 0.3 D or less.

A lower limit value and an upper limit value of the predetermined distance S is determined based on the following viewpoint. When the predetermined distance S becomes lower than the lower limit value, a distance between the slitted splitters 5, 6 and the non-slitted splitters 7 becomes extremely small. Accordingly, even when these splitters are displaced from each other so as to ensure a sufficient cross-sectional area of a flow passage, an advantageous effect of such a configuration cannot be obtained. On the other hand, when the predetermined distance S exceeds the upper limit value, a recirculation region formed by the non-slitted splitters 7 disappears before reaching the slitted splitters 5, 6 so that an advantageous effect cannot be obtained where a fuel gas is guided to the recirculation region formed by the non-slitted splitters 7 from the slitted splitters 5, 6.

The predetermined distance S may be adjusted by moving the non-slitted splitters 7 positioned on the upstream side in the direction of the fuel gas flow as indicated by arrows A in FIG. 2.

As shown in FIG. 1, the non-slitted splitters 7 are formed such that the downstream ends 7*a* have a fixed width in the direction of the longitudinal axis (an axis in the vertical direction) of the non-slitted splitters 7. On the other hand, the slitted splitter 5 disposed in the center has a plurality of slits SL each of which partially reduces a width of the downstream end 5*a*. The slitted splitter 5 disposed in the center has the slits SL on both side portions thereof at the same height position. With the formation of these slits, the slitted splitter 5 has wide portions W1 and narrow portions W2.

Figure 3:
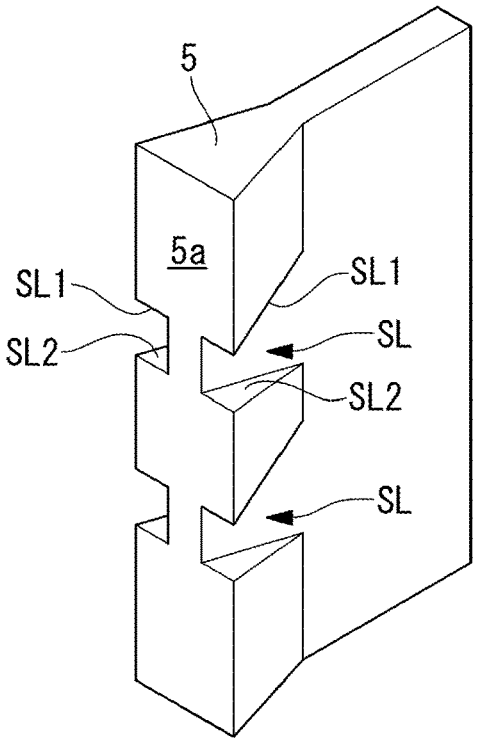
FIG. 3 is a perspective view showing a slitted splitter.

FIG. 3 specifically shows a shape of the slits SL. Each slit SL is formed by notching the downstream end 5*a* of the slitted splitter 5 in a U shape. Further, an upper surface SL1 and a lower surface SL2 forming the slit SL form surfaces which deflect a fuel gas flow in the direction of the longitudinal axis of the splitter 5 (the up-and-down direction in this embodiment). That is, the upper surface SL1 deflects the fuel gas flow in the downward direction, and the lower surface SL2 deflects the fuel gas flow in the upward direction.

As shown in FIG. 1, the slitted splitter 6 disposed at both ends also has slits SL substantially equal to the slits SL formed on the slitted splitter 5 disposed at the center.

However, the slits SL are formed only on a side of each slitted splitter 6 on the center side of the fuel nozzle 3. This is because when the slits SL are formed also on a side of each slitted splitter 6 on the wall portion side of the fuel nozzle 3, there is a possibility that the slits SL form ignition surfaces to cause external ignition.

It is preferable that the slits SL be formed at a center portion of the splitters 5, 6 in the longitudinal direction so as to allow ignition or flame holding to be performed at a position as close as possible to the center side of the fuel nozzle 3, and that the slits SL be not formed at both upper and lower end portions of the splitters 5, 6.

Assuming a length of the splitters 5, 6 as $L_0$, a range $L_1$ where the slits SL are formed is set such that an expression $L_1/L_0$ becomes 0.8 or less, and is preferably 0.5 or less.

As shown in FIG. 1, flow straightening plates 15 each separating these splitters 5, 6, 7 and the wall portion of the fuel nozzle 3 from each other are formed on upper and lower ends of the splitters 5, 6, 7 in the longitudinal axis. Accordingly, the flow straightening plate 15 disposed on the upper side separates a fuel gas flowing on the side of the splitters 5, 6, 7 and a fuel gas flowing on the side of the upper wall portion 3*b* of the fuel nozzle 3 from each other. The flow straightening plate 15 disposed on the lower side separates a fuel gas flowing on the side of the splitters 5, 6, 7 and a fuel gas flowing on the side of the lower wall portion 3*a* of the fuel nozzle 3 from each other.

According to the combustion burner 1 having the configuration described above, the following manner of operation and advantageous effects can be acquired.

With the use of the slitted splitters 5, 6 having the slits SL, an edge length of splitter length is increased so that flame holding performance is enhanced. Accordingly, internal flame holding where a flame is held on the inside of the fuel nozzle 3 is strengthened. The non-slitted splitters 7 form a recirculation region on the downstream of the widened portion 10 and thus have a flame holding function, but also have a function as a guide member which guides fuel to the slitted splitters 5, 6 disposed adjacently to the non-slitted splitters 7 by making use of the inclined surfaces of the widened portion 10. Accordingly, internal flame holding by the slitted splitters 5, 6 is further strengthened. In this way, internal flame holding is strengthened by the combination of the slitted splitters 5, 6 and the non-slitted splitters 7 so that reduced combustion is promoted whereby NOx generated in a flame region of the burner can be reduced.

The upper surface SL1 and the lower surface SL2 which are the inclined surfaces forming the slit SL deflect a fuel gas flow in the direction of the longitudinal axis of the splitters 5, 6. Accordingly, the fuel gas flow can become turbulent also in the direction of the longitudinal axis and hence, flame holding performance can be further enhanced. Particularly, the slit SL can be three-dimensionally formed by respective surfaces forming the slit SL and hence, flame holding performance can be enhanced.

The splitters 5, 6, 7 are disposed at different positions in the direction of the fuel gas flow. Accordingly, compared to a case where the splitters 5, 6, 7 are disposed at the same position in the direction of the fuel gas flow, an area occupied by the widened portions 10 of the splitters can be reduced. With such a configuration, an increase in speed of a fuel gas can be suppressed so that a flow speed of a fuel gas toward the downstream side in the direction of the fuel gas flow can be approximated to a combustion speed of a fuel gas toward the upstream side, ignition can be performed at an early stage before the fuel gas further flows toward the downstream side, and hence, flame holding performance of the flame can be enhanced.

The non-slitted splitters 7 positioned on the upstream side in the fuel gas flow guide a fuel to the recirculation region for the slitted splitters 5, 6 on the downstream side so that ignition or flame holding by the slitted splitters 5, 6 on the downstream side can be strengthened. In this way, when a main function of a splitter is to guide pulverized coal, it is preferable to use the non-slitted splitter 7 as the splitter.

By providing the flow straightening plates 15, each of which separates the wall surface side of the fuel nozzle 3 and the splitters 5, 6, 7 from each other, external ignition, where ignition is performed at the upper end portion or the lower end portions of the splitters 5, 6, 7, can be suppressed so that internal ignition and flame holding can be further strengthened.

In this embodiment, the non-slitted splitters 7 are disposed on the upstream side, and the slitted splitters 5, 6 are disposed on the downstream side, but the non-slitted splitters 7 and the slitted splitters 5, 6 may be disposed in a reversed arrangement, that is, the non-slitted splitters 7 may be disposed on the downstream side, and the slitted splitters 5, 6 may be disposed on the upstream side. This configuration is adopted when a fuel is used which is expected to ignite at an early stage. Ignition is performed at the early stage by the slitted splitters 5, 6 disposed on the upstream side, and the non-slitted splitters guide a fuel gas to a recirculation region formed by these slitted splitters 5, 6.

Figure 4:
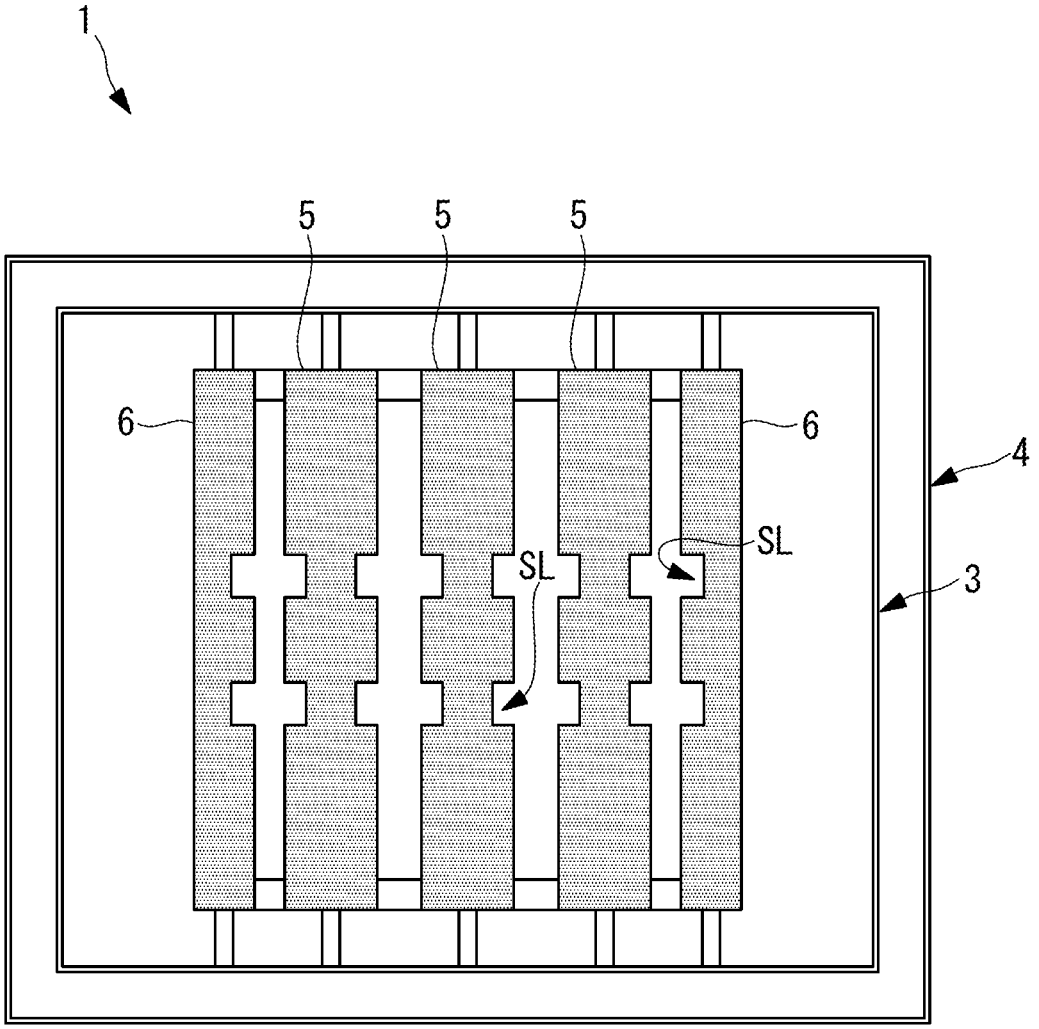
FIG. 4 is a front view showing a modification of the first embodiment.

Further, as shown in FIG. 4, all splitters may be formed of the slitted splitters 5, 6. With such an arrangement, the slitted splitters 5, 6 are disposed adjacently to each other, and the wide portions W1 having no slit SL oppositely face each other so that a fuel guided by the wide surface of one splitter is introduced to the downstream side of the other splitter. In this way, a fuel is guided between the wide portions W1 disposed adjacently to each other in an oppositely facing manner so that flame holding is strengthened on both splitters.

Second Embodiment

Next, a second embodiment of the present disclosure is described with reference to FIGS. 5 and 6.

This embodiment differs from the first embodiment with respect to a point that tapered portions, where corner portions of the splitters 6 are removed, are formed on the splitters 6, and is the same in other respects. Accordingly, components in common are given the same reference numerals, and description thereof is omitted.

Figure 5:
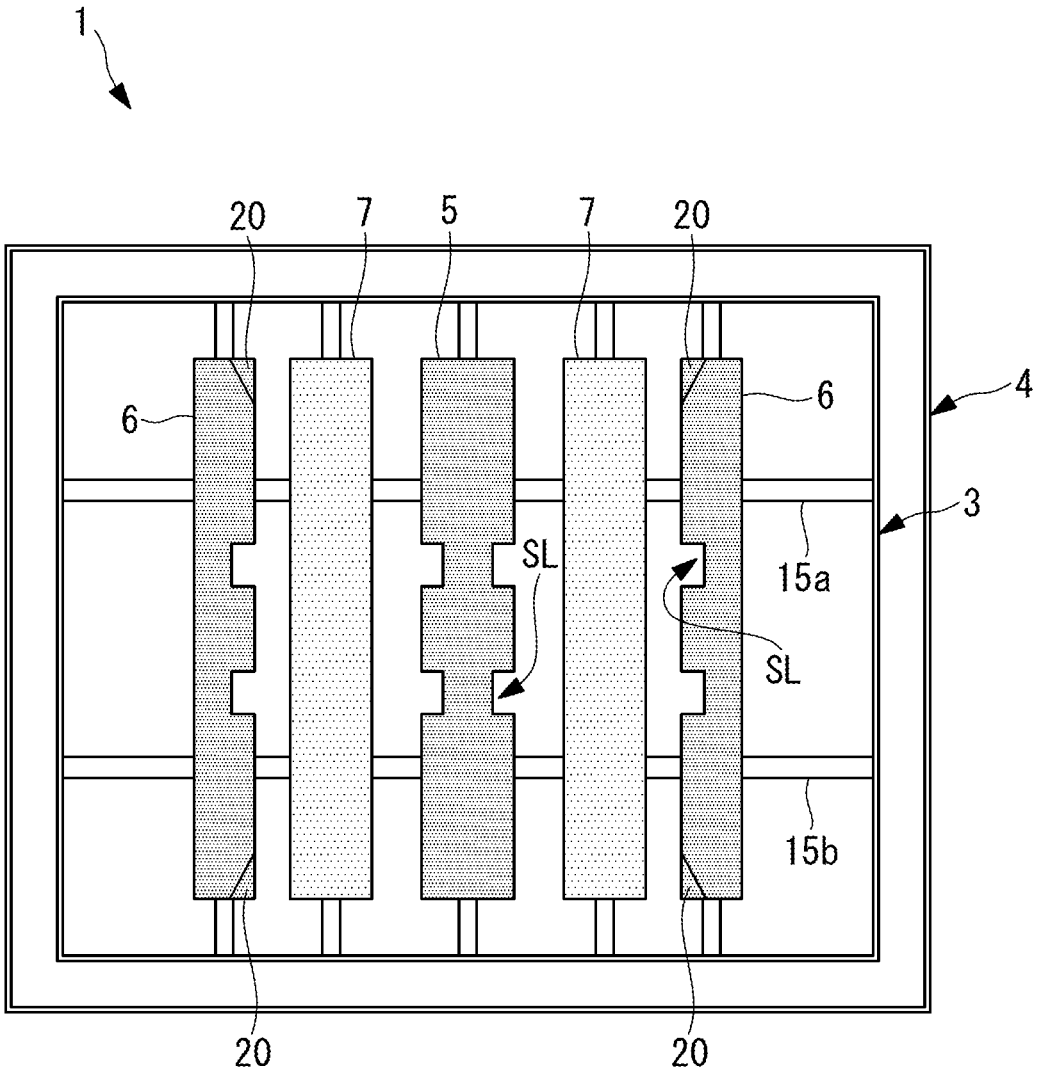
FIG. 5 is a front view showing a fuel nozzle according to a second embodiment of the present disclosure.
Figure 6:
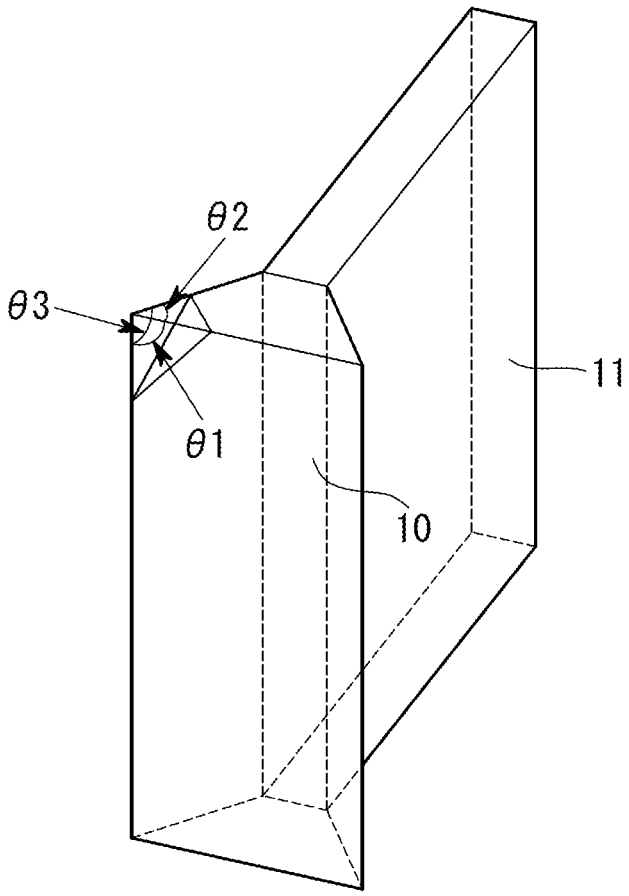
FIG. 6 is a perspective view showing a tapered portion shown in FIG. 5.

As shown in FIG. 5, each of the slitted splitters 6 disposed at both ends has a tapered portion (corner-removed portion) 20 at upper and lower corner portions thereof on the center-portion-side of the fuel nozzle 3.

The tapered portion 20 may have any shape provided that the corner portion is removed. As shown in FIG. 6, it is sufficient for the tapered portion 20 to have a shape where respective vertex angles 81, 82, 83 of three surfaces forming the corner portion are removed. Accordingly, the tapered portion 20 may be formed of a flat surface such as a tapered surface or may be formed of a curved surface.

In this embodiment, unlike in the first embodiment, two flow straightening plates 15*a*, 15*b* are provided. The respective flow straightening plates 15*a*, 15*b* are disposed at height positions symmetrical with each other with respect to a center position of the fuel nozzle 3 in the height direction, and are formed of plate bodies extending in the horizontal direction.

According to this embodiment, the tapered portion 20, where the corner portion is removed, is formed so that it is possible to suppress a phenomenon that the splitter 6 receives radiation from the inner peripheral surface side of the fuel nozzle 3 so that ignition occurs at the corner portion as a starting point whereby external ignition occurs at an outer peripheral portion of the fuel nozzle 3.

The tapered portion (corner-removed portion) 20 may be also formed on other splitters. That is, the tapered portion 20 may be also formed on the slitted splitter 5 disposed at the center or on the non-slitted splitters 7.

In the embodiments described above, five splitters are used. However, the present disclosure is not limited to such a configuration. Two to four splitters may be used, or six or more splitters may be used. The optimum number of splitters is designed depending on a size of a fuel nozzle.

In the respective embodiments described above, the description is made with respect to a case where the splitters 5, 6, 7 are vertical splitters extending in the up-and-down direction as one example. However, the present disclosure is also applicable to a case where the splitters 5, 6, 7 are lateral splitters extending in the horizontal direction.

Further, in the embodiments described above, the description has been made mainly with respect to a case where the fuel is pulverized coal. However, the fuel is not limited to pulverized coal, and the present disclosure is also applicable to a case where the fuel is petroleum coke, a petroleum residue or a biomass fuel (in the form of a solid or slurry).

REFERENCE SIGNS LIST

1 combustion burner
3 fuel nozzle
4 combustion air supply nozzle
slitted splitter
6 slitted splitter
7 non-slitted splitter
10 widened portion
15 flow straightening plate
20 tapered portion (corner-removed portion)

The invention claimed is:

1. A combustion burner comprising:

a fuel nozzle through which a fuel gas obtained by mixing a fuel and air with each other is blown into a furnace; and a plurality of splitters configured to divide a fuel gas flow by a widened portion where a width of the widened portion increases as the widened portion extends in a direction of the fuel gas flow, the splitters being disposed in the fuel nozzle on a distal end side of the fuel nozzle such that longitudinal axes of the splitters extend from a side of one wall portion of the fuel nozzle to a side of the other wall portion which is disposed on a side opposite to said one wall portion, wherein the plurality of the splitters include: a slitted splitters configured to slit which partially reduces a width of the widened portion at a downstream end in the fuel gas flow, and a non-slitted splitters configured to adjacently to the slitted splitters, the non-slitted splitters having the widened portion, and the widened portion at a downstream end in the fuel gas flow having a fixed width in a direction of the longitudinal axis, and the slitted splitters include wide portions having no slit.

2. A combustion burner comprising:

a fuel nozzle through which a fuel gas obtained by mixing a fuel and air with each other is blown into a furnace; and a plurality of splitters configured to divide a fuel gas flow by a widened portion where a width of the widened portion increases as the widened portion extends in a direction of the fuel gas flow, the splitters being disposed in the fuel nozzle on a distal end side of the fuel nozzle such that longitudinal axes of the splitters extend from a side of one wall portion of the fuel nozzle to a side of the other wall portion which is disposed on a side opposite to said one wall portion, wherein the splitter includes a plurality of slitted splitters having a slit which partially reduces a width of the widened portion at a downstream end in the fuel gas flow, and the slitted splitters disposed adjacently to each other respectively include wide surfaces having no slit, and the wide surfaces of the widened portions of the slitted splitters oppositely face each other.

3. The combustion burner according to claim 1, wherein a surface forming the slit of the slitted splitter is formed of an inclined surface which deflects the fuel gas flow in the direction of the longitudinal axis.

4. The combustion burner according to claim 1, wherein the splitters are disposed at different positions in the direction of the fuel gas flow.

5. The combustion burner according to claim 1, wherein a flow straightening plate configured to separate a wall surface side of the fuel nozzle and the splitter from each other is disposed at an end portion of the splitter in the longitudinal direction.

6. The combustion burner according to Previously Presented, wherein the splitter has a corner-removed portion, where a corner portion is removed, at a downstream end corner portion of the widened portion.

7. A boiler comprising:

a furnace;

the combustion burner described claim 1 which is provided in the furnace;

a flue provided on a downstream side of the furnace; and a heat exchanger provided in the flue.

* * * * *